US009799311B2

(12) United States Patent
Murray et al.

(10) Patent No.: US 9,799,311 B2
(45) Date of Patent: Oct. 24, 2017

(54) MARCHING TENOR DRUM ASSEMBLY HAVING UNITARY MULTIPLE-DRUM MOUNTING FRAME

(71) Applicant: BD Performing Arts, Concord, CA (US)

(72) Inventors: Allan Murray, Vero Beach, FL (US); Scott Johnson, Concord, CA (US)

( * ) Notice: Subject to any disclaimer, the term of this patent is extended or adjusted under 35 U.S.C. 154(b) by 0 days.

(21) Appl. No.: 15/413,266

(22) Filed: Jan. 23, 2017

(65) Prior Publication Data

US 2017/0213531 A1 Jul. 27, 2017

Related U.S. Application Data

(60) Provisional application No. 62/281,648, filed on Jan. 21, 2016.

(51) Int. Cl.

| | |
|---|---|
| ***G10D 13/02*** | (2006.01) |
| ***G10D 13/00*** | (2006.01) |
| ***G10G 5/00*** | (2006.01) |

(52) U.S. Cl.

CPC ..... *G10G 5/005* (2013.01); *G10D 13/00* (2013.01); *G10D 13/02* (2013.01); *G10D 13/023* (2013.01); *G10D 13/026* (2013.01); *G10G 5/00* (2013.01)

(58) Field of Classification Search

CPC ..... G10G 5/005; G10D 13/00; G10D 13/02

USPC ..... 84/421, 413, 411 R

See application file for complete search history.

(56) References Cited

U.S. PATENT DOCUMENTS

| | | | | |
|---|---|---|---|---|
| 2,834,244 A * | 5/1958 | Willits | G10D 13/04 | 84/411 R |
| 3,541,913 A * | 11/1970 | Severino | G10D 13/023 | 84/411 R |
| 3,974,732 A * | 8/1976 | Kester, Jr. | G10G 5/005 | 224/261 |
| 4,102,237 A * | 7/1978 | Suess | G10G 5/00 | 84/421 |
| 5,337,646 A * | 8/1994 | Austin | G10D 13/00 | 248/122.1 |
| 5,392,681 A * | 2/1995 | Hall | G10D 13/023 | 84/413 |

(Continued)

FOREIGN PATENT DOCUMENTS

| | | | |
|---|---|---|---|
| GB | 1488167 A * | 10/1977 | G10D 13/023 |

OTHER PUBLICATIONS

International Search Report and Written Opinion in corresponding International Application No. PCT/US2017/014627. (Apr. 10, 2017).

*Primary Examiner* — David Warren
*Assistant Examiner* — Christina Schreiber
(74) *Attorney, Agent, or Firm* — Brian Beverly; Beeson Skinner Beverly, LLP

(57) ABSTRACT

A marching tenor drum assembly includes a quad mounting frame and two individual mounting frames for receiving a plurality of tenor drums. A mounting lip of each drum shell rests on the top plate of one of the mounting frames, a compression rim of a bearing ring covers the mounting lip and is fastened to the mounting frame with a plurality of clamp screws. The drum skin of a top head is placed over the top edge of an upwardly extending support wall of the bearing ring. A top hoop is placed over a peripheral portion of the top head and is fastened to the clamp screws.

13 Claims, 7 Drawing Sheets

(56) References Cited

U.S. PATENT DOCUMENTS 5,410,938 A * 5/1995 Kurosaki ..... G10D 13/023 84/411 R
5,561,255 A * 10/1996 Sassmannshausen ..... G10D 13/023 84/413
5,810,224 A * 9/1998 Simons ..... G10G 5/005 224/265
5,973,247 A * 10/1999 Matthews ..... G10G 5/005 84/402
6,586,666 B2 * 7/2003 Abe ..... G10H 1/0016 84/411 R
7,074,995 B2 * 7/2006 Barakat ..... G10D 13/02 84/411 R
7,265,287 B2 * 9/2007 Shimada ..... G10G 5/005 84/104
7,423,210 B2 * 9/2008 Marwede ..... G10D 13/021 84/411 R
7,528,312 B1 * 5/2009 DiGiovanni ..... G10D 13/02 84/411 R
7,642,440 B2 * 1/2010 Bailey ..... G10D 13/00 84/411 R
7,807,910 B1 * 10/2010 Berardo ..... G10D 13/02 84/411 R
8,168,873 B2 * 5/2012 Okamoto ..... G10D 13/026 84/411 R
8,802,951 B2 * 8/2014 Hallerberg ..... G10D 13/026 84/421
8,884,151 B1 * 11/2014 Lee ..... G10H 3/146 84/464 R
9,286,867 B1 * 3/2016 Oliver ..... G10D 13/023
2003/0192423 A1 * 10/2003 Crouch ..... G10G 5/005 84/421
2005/0274854 A1 * 12/2005 May ..... G10D 13/026 248/171
2006/0081114 A1 * 4/2006 Shimada ..... G10G 5/005 84/421
2007/0017335 A1 * 1/2007 Marwede ..... G10D 13/021 84/411 R
2007/0283797 A1 * 12/2007 Crawford ..... G10D 13/02 84/411 R
2012/0318118 A1 * 12/2012 Miyajima ..... G10G 5/005 84/421
2013/0283997 A1 * 10/2013 Hallerberg ..... G10D 13/026 84/421
2014/0026732 A1 * 1/2014 Spinazzola ..... G10D 13/028 84/413
2014/0298971 A1 * 10/2014 Martin ..... G10D 13/023 84/413
2015/0206517 A1 * 7/2015 Mihos ..... G10D 13/023 84/411 R
2015/0379973 A1 * 12/2015 Hegdahl ..... G10D 13/023 84/413

* cited by examiner

MARCHING TENOR DRUM ASSEMBLY HAVING UNITARY MULTIPLE-DRUM MOUNTING FRAME

CROSS-REFERENCE TO RELATED APPLICATIONS

This application claims the benefit of U.S. Provisional Application No. 62/281,648, filed Jan. 21, 2016, which is incorporated herein by reference.

BACKGROUND

Field of the Invention

A marching tenor drum assembly having a unitary multiple-drum mounting frame relates to musical instruments generally and in particular to a mounting assembly for a set of marching band tenor drums.

Discussion of the Prior Art

A marching tenor drum assembly requires interconnecting the drums in a strong stable configuration which can, in turn, be attached to and hung from a carrier. Each tenor drum comprises a shell the top opening of which is covered by a batter or top head. The perimeter of the top head is covered with a top rim or hoop which is held to the shell using tension rods. Each of the tension rods is attached to a lug casing firmly affixed to the side of the shell.

The conventional way to interconnect the drum set is to provide a support frame having dual vertically spaced apart support plates having scalloped forward and rear edges against which the drum shells fit with the lug casings interposed there between. The tension rods are fed through apertures in the top plate and into the lug casing and retaining bolt is fed through an aperture in the bottom plate and into the lug casing from beneath, such that tightening the tension rods and the retaining bolt secures the drum to the support frame.

While the above-described method for interconnecting a set of marching tenor drums works, the hardware required can be relatively heavy and burdensome to carry for extending periods of time, and the assembly and disassembly of the drum set can be tedious and cumbersome. There is, therefore, a need for a marching tenor drum assembly that is lighter and easier and quicker to assemble and break down.

SUMMARY OF THE INVENTION

A marching tenor drum assembly having unitary multiple-drum mounting frame comprises a plurality of tenor drums, a multiple-drum mounting frame and one or more single-drum mounting frames attached to the multiple-drum mounting frame. In one embodiment of the invention, the multiple-drum mounting frame is configured for mounting four tenor drums. Each of the drums includes a shell having a mounting lip extending outwardly from the top edge thereof. The shell is received in one of the drum openings of one of the mounting frames with the mounting lip resting on the top plate of the mounting frame. An inwardly extending annular compression rim of a bearing ring covers the mounting lip of the shell and is fastened with clamp screws to the top plate of the mounting frame thereby securing the mounting lip to the top plate and fixing the drum in the drum opening. Each of the clamp screws includes an upwardly opening reverse threaded internal bore. An annular support wall extends upwardly from the compression rim of the bearing ring.

The drum skin of a top batter head is placed over and across the drum head opening formed by the top edge of the support wall, with a peripheral edge portion of the drum skin extending outward from the support wall. A top hoop is placed over the peripheral edge portion of the top head and fastened to the bearing ring, and hence to the mounting frame, with a plurality of tension rods, each of which is threadedly received in the internal bore of one of the clamp screws. Cutout portions are provided in adjacent top hoops to improve freedom of movement between adjacent drum heads.

A carrier assembly includes a pair of extension bars received in two openings in the proximal portion of a perimeter wall of the multiple-drum mounting frame and adjustably attached to the top plate of the mounting frame such that the distances which the extension bars extend from the perimeter wall can be selectively set. A back bar for resting against a performer's drum carrier belly plate extends between and interconnects the proximal ends of the extension bars.

DETAILED DESCRIPTION OF THE ILLUSTRATED EMBODIMENT

Figure 1:
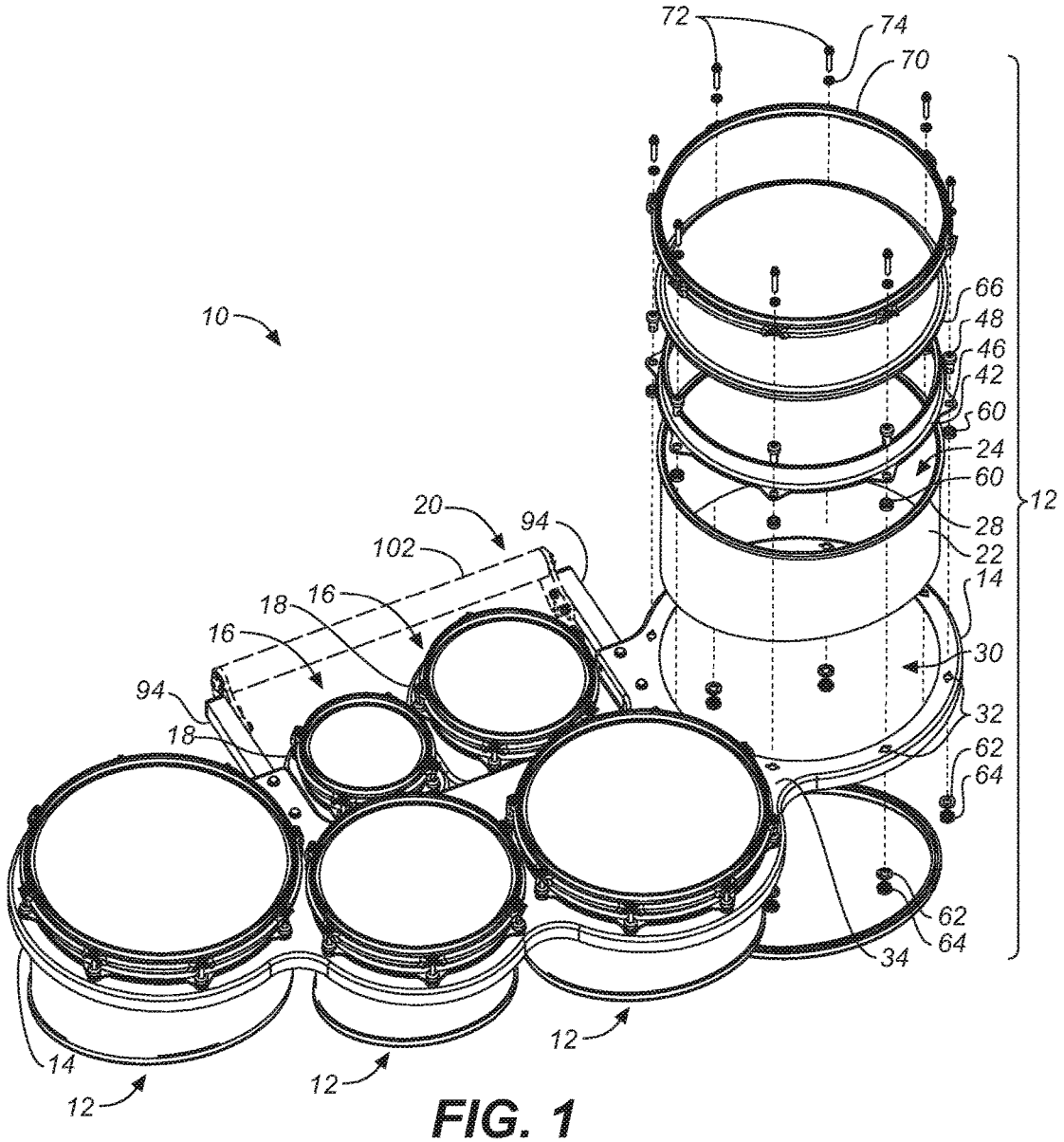
FIG. 1 is an upper perspective view of a marching tenor drum assembly according to the invention showing one of the drums in exploded view.

A marching tenor drum assembly, referred to generally at numeral 10 in FIG. 1, comprises a set of four large tenor drums 12, generally referred to as a "quad," a quad mounting frame 14 for mounting the quad, a set of two smaller tenor drums 16, each having an individual mounting frame 18, and a carrier assembly 20. The quad drums 12 are commonly provided in sizes of 10", 12", 13" and 14", and the smaller drums 16 are generally sized 6" and 8" and are generally provided in pairs sized 6" and 6" or 6" and 8". It will be understood that, while a mounting frame for four tenor drums is disclosed herein, mounting frames for holding multiple tenor drums greater or lesser than four are intended to be included in the scope of the invention.

Figure 2:
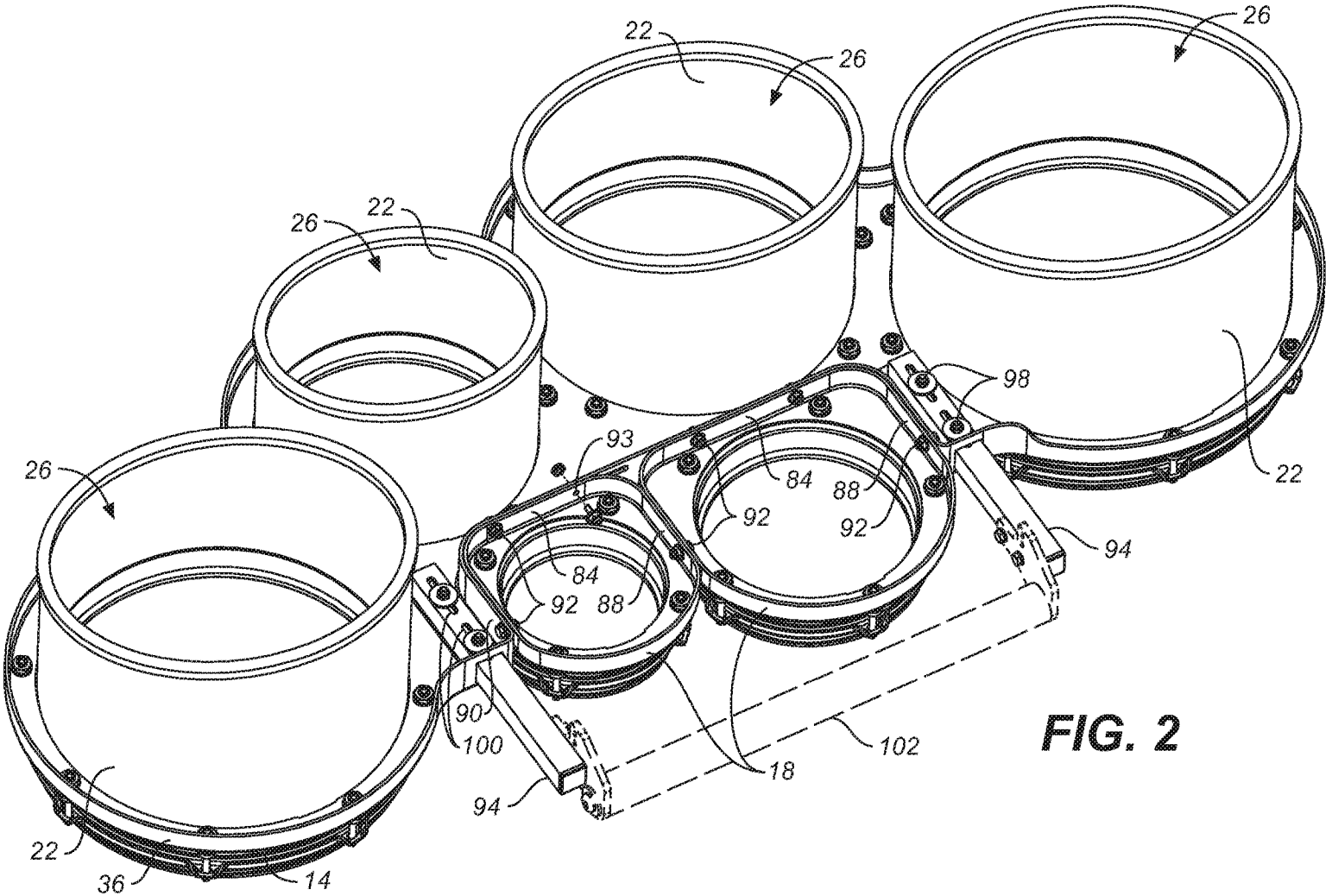
FIG. 2 is a lower perspective view of the marching tenor drum assembly seen in FIG. 1, but shown in an assembled configuration.

With additional reference to FIG. 2, it is seen that each tenor drum comprises a cylindrical shell 22 forming a top opening 24 (indicated in FIG. 1) and a bottom opening 26. A reinforcing mounting lip 28 extends outwardly at the upper edge of the shell 22.

Figure 3A:
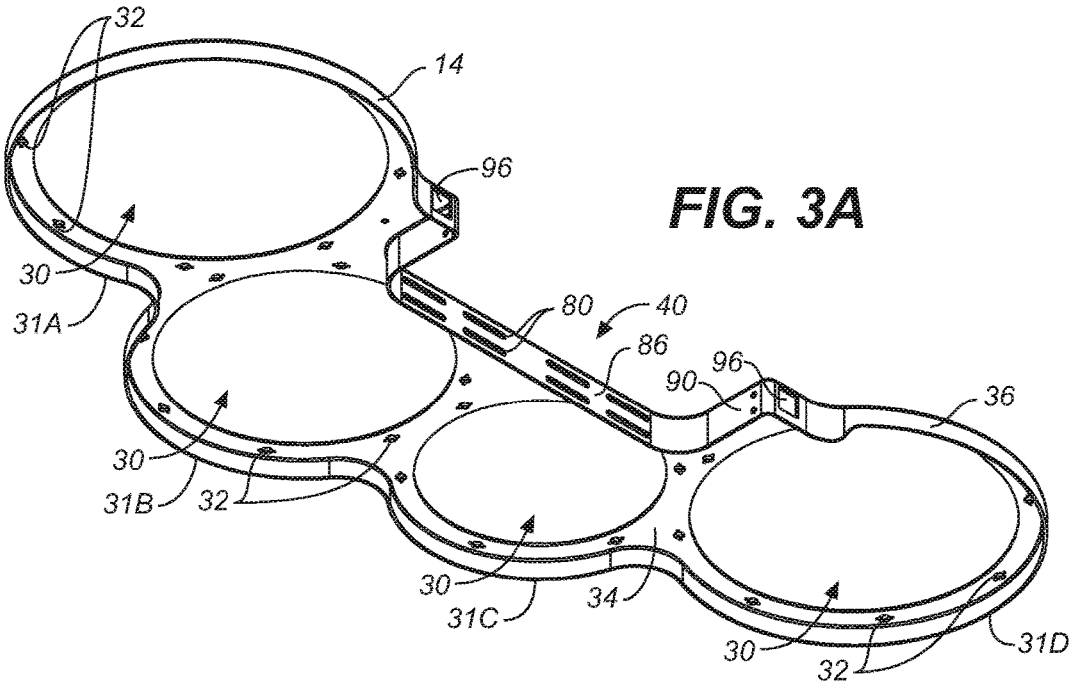
FIGS. 3A and 3B are bottom rear and top rear perspective views, respectively, of the quad mounting frame thereof.
Figure 3B:
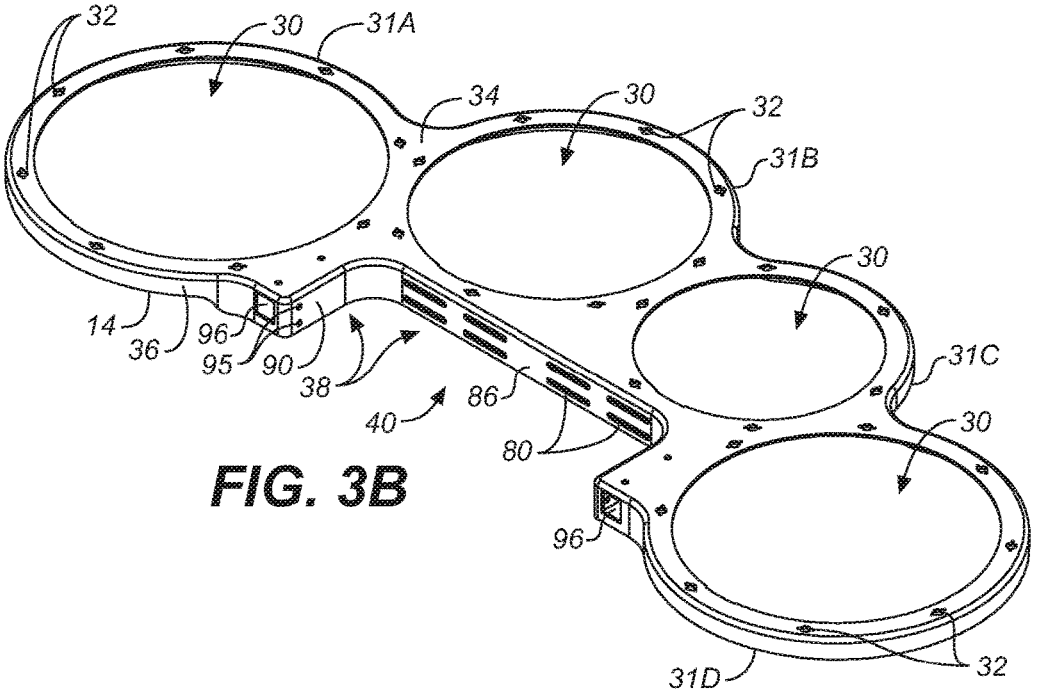

Referring now to FIGS. 3A and 3B, the quad mounting frame 14 is generally knuckle-shaped and includes four drum openings 30, forming containment arcs 31A, 31B, 31C and 31D, each of which is sized to closely receive one of the tenor drums 12. A plurality of apertures 32 in the top plate 34 of the frame 14 surrounds each of the drum openings 30, and a perimeter rim 36 depends from the outer edges of the frame 12. A rectangular portion 38 of the perimeter wall 36 forms a rectangular recess 40 on the proximal portion of the frame 14 for receiving the two smaller drums 16 as shown in FIGS. 1 and 2. In one embodiment of the invention, the quad mounting frame 14 is manufactured from carbon fiber.

Figure 1A:
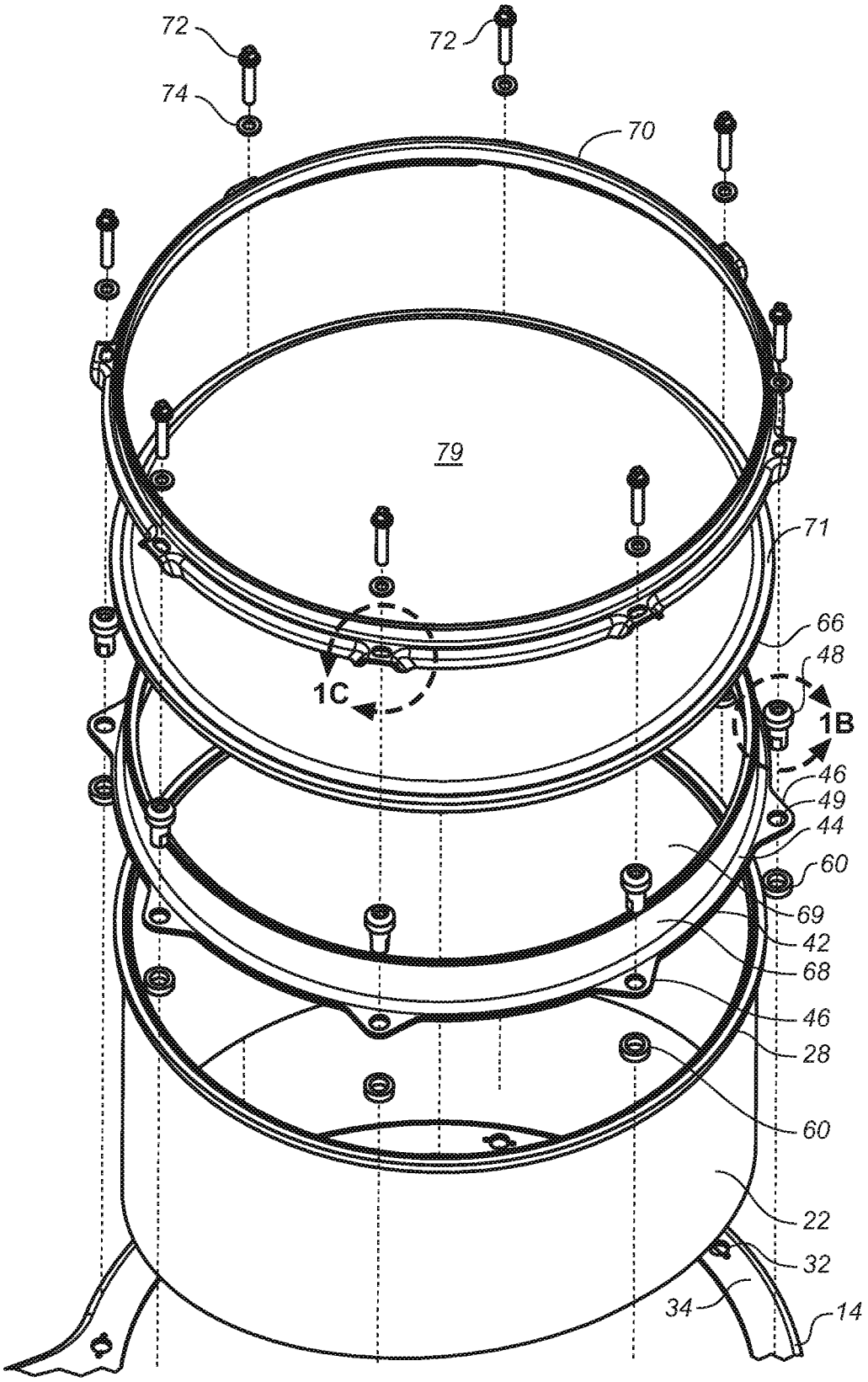
FIG. 1A is an enlarged view of the exploded upper perspective view of the tenor drum shown in FIG. 1.
Figure 1B:
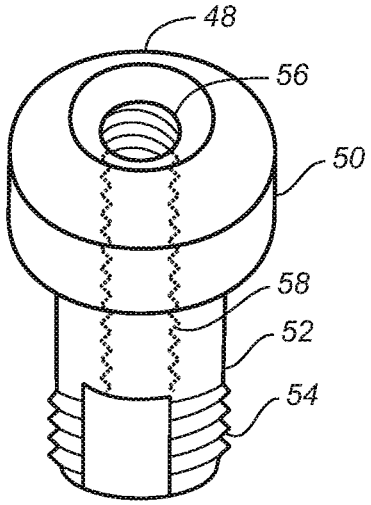
FIG. 1B is a perspective view of a clamp nut of the marching tenor drum assembly.

As seen in FIGS. 1 and 1A, each of the quad drums 12 is received in one of the drum openings 30 with the mounting lip 28 of the drum resting on the top plate 34 of the mounting frame 14. An annular bearing ring 42 is disposed over the mounting lip 28 of each drum 12, with an inwardly extending compression rim 44 thereof covering the mounting lip 28. A plurality of attachment ears 46 extend outward from compression rim 44. Each flange is angularly arranged about compression rim 44 to cooperate with apertures 32 in the top plate 34 of the mounting frame 14. The bearing ring 42 is secured to the quad mounting frame 14 by a plurality of clamp screws 48. As seen in FIG. 1B, each clamp screw 48 includes a head 50, a shaft 52 having external bottom threads 54, and an internal bore 56 having reverse threads 58.

Figure 4:
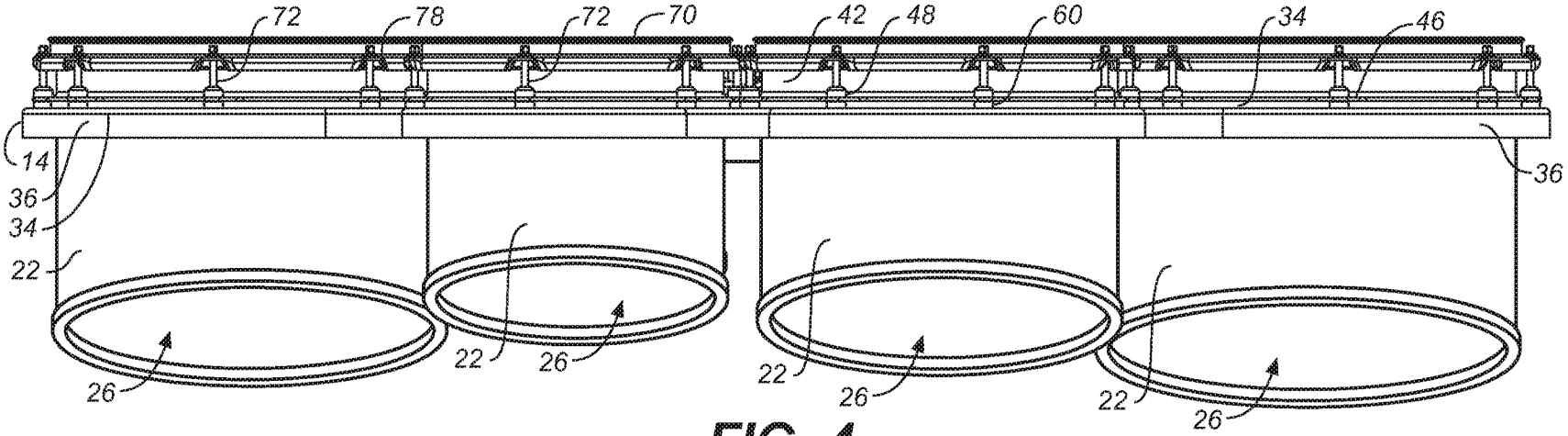
FIG. 4 is a front elevation view thereof.

With particular reference now to FIGS. 1A, 1B and 4, each clamp screw 48 is inserted through a clamp screw aperture 49 in one of attachment ears 46, through a spacer 60 interposed between the attachment ear 46 and the top plate 34 of the quad mounting frame 14, and finally through one of the apertures 32 in top plate 34. The bearing ring 42 is secured to the quad mounting frame 14 using washers 62 and nuts 64 which engage the bottom threads 54 of the clamp screws 48 to hold the drum shell 12 to the mounting frame 14.

Figure 1C:
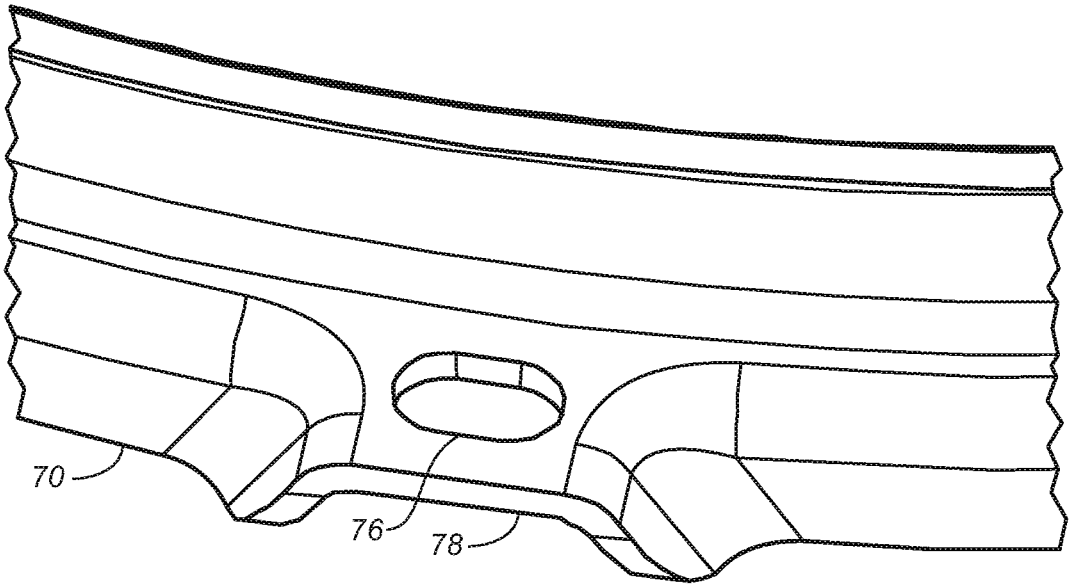
FIG. 1C is an enlarged upper perspective view of a portion of FIG. 1 showing a plurality of mounting ears on the top hoop.

The top head 66 of the drum is placed over the top edge of a support wall 68 that extends upwardly from the lip 44 of bearing ring 42 and forms drum head opening 69. Top hoop 70 is placed over a peripheral edge portion 71 of head 66. Tension rods 72 equipped with washers 74 are inserted through holes 76 in outward projecting upwardly arched mounting ears 78 and into the internal bores 56 of clamp screws 48 to fasten top hoop 70 to bearing ring 42 and adjustably stretch drum skin 79 of top head across drum head opening 69. See FIG. 1C. Tightening of tension rods 72 is performed in a counter-clockwise direction because internal threads 58 of bores 56 are, as mentioned above, reverse threaded.

In one embodiment of the assembly, quad mounting frame 14 and bearing ring 42 are manufactured of carbon-fiber steel. In another embodiment, the bearing ring 42 is manufactured from a magnesium alloy, but the quad mounting frame 14 is manufactured from carbon-fiber steel.

With reference again to FIG. 1, it can been seen that all four quad drums 12 are mutually attached to quad mounting frame 14 in a unifying assembly that eliminates the need for lug casings attached to the shell and for a carrier requiring dual support plates and additional hardware for attaching each drum to the lug casings and tension rods. The marching tenor drum assembly is considerably lighter than the prior art assembly and easier and quicker to assemble and disassemble.

Figure 7:
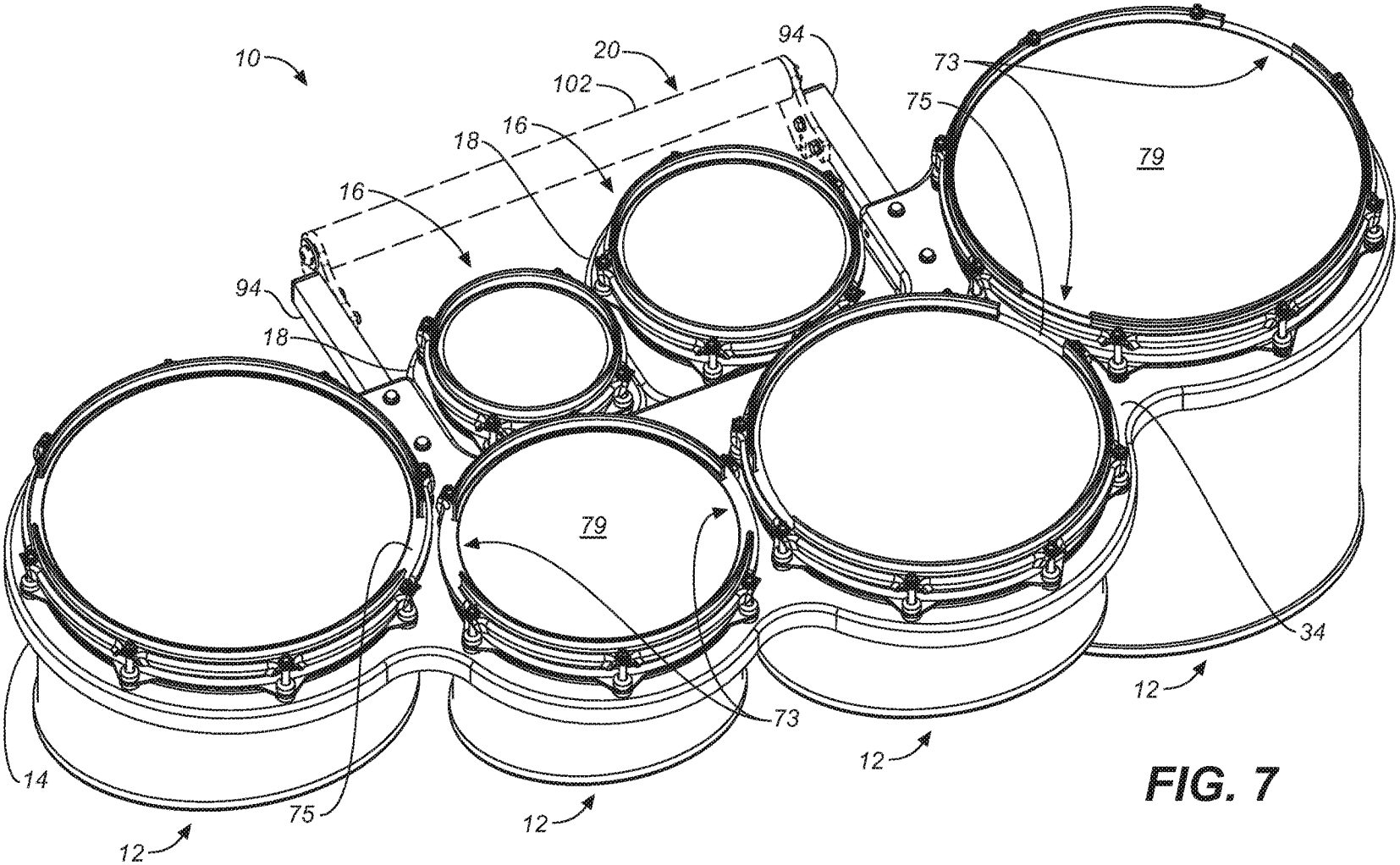
FIG. 7 is a upper rear perspective view of another embodiment of a marching tenor drum assembly.

In one embodiment of the invention shown in FIG. 7, cutout portions 73 are provided on opposite sides of each of the top hoops 70. Each of the cutout portions includes a bottom edge 75 that rises no higher than the drum skins 79 of the drums. The cutout portions 73 positioned next to each other in adjacent pairs of top hoops 70 as shown improve freedom of movement between adjacent drums and reduce rim clicks made by drums sticks during such movement.

Figure 5:
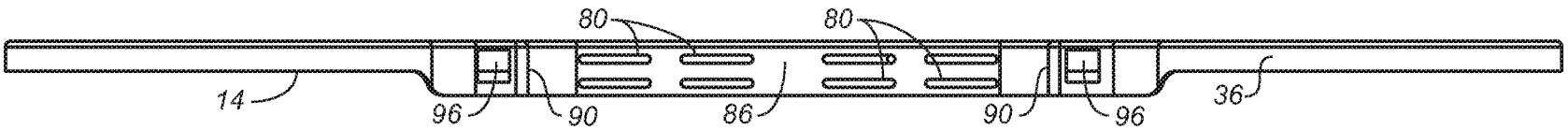
FIG. 5 is a rear elevation view of the quad mounting frame shown in FIGS. 3A and 3B.
Figure 6:
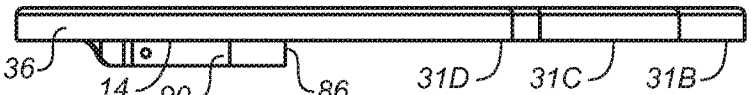
FIG. 6 is a side elevation view thereof.

Referring next to FIGS. 3A, 3B and 5, two vertically spaced sets of anchor slots 80 are provided in the rectangular portion 38 of perimeter rim 36 of the quad mounting frame 14. Each of the two smaller drums 16 includes the same elements as does each of the quad drums 12 discussed above and is mounted on an individual drum mounting frame 18 similar in construction to quad mounting frame 14. With additional reference again to FIG. 2, it is seen that each individual mounting frame 18 includes a rear wall 84 for cooperation with the front wall 86 of the recess 40 of the quad mounting frame 14 and opposing side walls 88 for cooperation with the lateral walls 90 thereof and with the side walls 88 of the other individual mounting frame 18. The individual mounting frames 18 are attached to the quad mounting frame 14 by positioning one side wall 88 of each frame 18 abutting the other, abutting the rear walls 84 of each individual frame 18 with the front wall 86 of recess 40, and abutting the other side wall 88 of each frame with one of the lateral walls 90 of recess 40. Fasteners 92 are inserted through anchor holes 93 in rear walls 84 of each individual frame and through one row of the anchor slots 80 in the front wall of recess 40 that register with the anchor holes 93. Similarly, fasteners 92 are inserted through holes in the side walls 88 to join the two abutting side walls, and through fastener holes in the side walls 88 through corresponding fastener holes 95 in the lateral walls 90 of the recess 40.

Dual extension bars 94 inserted through openings 96 located in the perimeter wall 36 of quad mounting frame 14 on each side of the recess 40 can be adjustably positioned adjacent lateral walls 90. The extension bars 94 are secured in place with fasteners 98 that are inserted in adjustment slots 100 provided in quad mounting frame 14 enabling the length that bars 94 extend from the frame to be selectively adjusted. A back bar 102 interconnects the proximal ends of each of the extension bars 94 and can be positioned relative to the quad frame 14 and small drums 16 by adjusting the positions of extension bars 94.

A marching tenor drum assembly having a unitary multiple-drum mounting frame has unique advantages over prior art marching tenor drum assemblies. The multiple-drum mounting frame holds all the drums level and securely preventing the drums from shifting angularly during movement by the player. The unitary construction of the frame eliminates numerous lugs and tension screw holders giving the assembly reduced weight. The arrangement of the drum holes positions the drums in an ergonomic configuration that allows them to be played with reduced effort. Cutouts in the hoops allow freer movement between adjacent drums and eliminate rim clicks. Affixing the drum to the mounting frame eliminates lug casings that are conventionally attached to the sides of the drum, not only reducing weight, but freeing the drum to resonate. The unitary multiple-drum mounting frame simplifies set up and breakdown of the assembly and makes an attractive presentation.

There have thus been described and illustrated certain embodiments of a marching tenor drum assembly having a unitary multiple-drum mounting frame according to the invention. Although the present invention has been described and illustrated in detail, it should be clearly understood that the disclosure is illustrative only and is not to be taken as limiting.

We claim:

1. A marching tenor drum assembly having a unitary multiple-drum mounting frame, the marching tenor drum assembly comprising:

a plurality of tenor drums, and one or more mounting frames, each of the one or more mounting frames having a top plate including one or more drum openings, each of said plurality of tenor drums including:

a cylindrical shell having a mounting lip extending radially therefrom, the shell received in one of the one or more drum openings of one of the one or more mounting frames with the mounting lip resting on the top plate thereof, a bearing ring having an annular compression rim and an annular support wall, the compression rim covering the mounting lip of the shell, the support wall extending upwardly from the compression rim and bounding a drum head opening, a top head having a drum skin including a peripheral edge portion, the drum skin placed over the top edge of the support wall of the bearing ring across the drum head opening, the peripheral edge portion extending radially outward from the support wall, and a top hoop placed over the peripheral edge portion, wherein, the bearing ring of each of said plurality of tenor drums is fastened to one of the one or more mounting frames thereby compressing the mounting lip of the shell of the drum onto the top plate of the mounting frame, and the top hoop of the drum is fastened to the mounting frame thereby securing the top head on the support wall of the bearing ring.

2. The marching tenor drum assembly of claim 1 further comprising:

a plurality of clamp screws, each of the plurality of clamp screws having a threaded internal bore, the plurality of clamps screws fastening the bearing rings of each of the plurality of drums to one of the plurality of mounting frames, and a plurality of tension rods, each of the plurality of tension rods threadedly received in the internal bore of one of the plurality of clamp screws and fastening the top hoops of the plurality of drums to the bearing rings thereof.

3. The marching tenor drum assembly of claim 2 further comprising:

the top hoop of each of said plurality of tenor drums including a plurality of outwardly projecting mounting ears, each of the plurality of mounting ears having a fastener hole, and each of the plurality of tension rods received in the fastener hole of one of the plurality of mounting ears.

4. The marching tenor drum assembly of claim 2 further comprising:

the top plate of each of the plurality of mounting frames having a bottom surface and a plurality of apertures surrounding each of the one or more drum openings, a plurality of clamp nuts disposed on the bottom side of the top plate, the bearing ring of each of the plurality of tenor drums including a plurality of attachment ears extending radially from the compression rim thereof, each of the plurality of attachment ears including a clamp screw aperture, and each of the plurality of clamp screws having a head and a shaft including external threads, the shaft extending through the clamp screw aperture of one of the plurality of attachment ears and through one of the plurality of apertures of the top plate of one of the plurality of mounting frames, whereby the shaft is threadedly received in one of the plurality of clamp nuts for fastening the bearing ring of each of the plurality of tenor drums to the top plate of one of the plurality of mounting frames.

5. The marching tenor drum assembly of claim 4 wherein:

the internal threads of the internal bore of each of the plurality of clamp screws are reverse threaded.

6. The marching tenor drum assembly of claim 1 wherein:

the plurality of tenor drums includes four tenor drums, and the plurality of mounting frames includes a unitary quad mounting frame configured for receiving the four tenor drums.

7. The marching tenor drum assembly of claim 1 wherein:

the plurality of mounting frames includes a unitary multiple-drum mounting frame configured for receiving a plurality of the plurality of tenor drums the one or more mounting frames include one or more individual drum mounting frames each mounting to the multiple-drum mounting frame, each of the individual drum mounting frames for receiving one of the plurality of the plurality of tenor drums.

8. The marching tenor drum assembly of claim 7 wherein:

the multiple-drum mounting frame includes a recess formed by a front wall and opposing lateral side walls, the front wall including a plurality of sets of vertically spaced apart anchor slots, each of the one or more individual drum mounting frames includes a rear wall and opposite side walls, the rear wall having a plurality of anchor holes which are horizontally spaced apart to register with a selected one of the plurality of sets of anchor slots, a plurality of fasteners received in the plurality of anchor holes of each of the one or more individual mounting frames and received in a selected one of the plurality of sets of anchor slots to fasten the mounting frame to the multiple-drum mounting frame at a selected height relative thereto.

9. The marching tenor drum assembly of 8 further comprising:

the lateral walls of the multiple-drum mounting frame each including a plurality of vertically spaced anchor holes, and each of the one or more individual drum mounting frames including opposite side walls, each side wall having an anchor hole, wherein one of the plurality of fasteners is received in the anchor hole of the side wall of each of the one or more individual drum mounting frames and is received in a selected one of the plurality of vertically spaced anchor holes in one of the lateral walls of the multiple-drum mounting frame to fasten the individual mounting frame to the multiple-drum mounting frame.

10. The marching tenor drum assembly of claim 7 further comprising:

the multiple-drum mounting frame including a perimeter wall including two openings, the top plate of the multiple-drum mounting frame including two or more carrier fastener holes, a carrier assembly having a pair of extension bars received in the two openings, each of the pair of extension bars having one or more longitudinally extending fastener slots, a back bar extending between the pair of extension bars, the back bar for engagement with the carrier belly plate of a performer, and a plurality of carrier fasteners each received in one of the two or more carrier fastener holes and in one of the fastener slots of one of the extension bars at a selected location for adjustably positioning the back bar with respect to the multiple-drum mounting frame.

11. The marching tenor drum assembly of claim 1 wherein:

each of the top hoops of said plurality of tenor drums includes cutout portions on opposite sides thereof, each of the cutout portions having a bottom edge disposed no higher than the drum skins of the top heads of said plurality of tenor drums, the plurality of tenor drums including one or more pairs of adjacent tenor drums, and one of the two cutout portions of the top hoop of one drum each adjacent pair of drums is disposed adjacent to one of the cutout portions of the top hoop of the other of the adjacent pair of drums.

12. A marching tenor drum assembly having a unitary multiple-drum mounting frame, the marching tenor drum assembly comprising:

a plurality of tenor drums, and one or more mounting frames, each of the one or more mounting frames having a top plate including one or more drum openings, each of said plurality of tenor drums including:

a cylindrical shell having an upper edge and a mounting lip extending radially therefrom, the shell received in one of the one or more drum openings of one of the one or more mounting frames with the mounting lip resting on the top plate thereof, a bearing ring having an annular compression rim and an annular support wall, the compression rim covering the mounting lip of the shell, the support wall extending upwardly from the compression rim and bounding a drum head opening, a plurality of clamp screws, each of the plurality of clamp screws having a reverse threaded internal bore, the plurality of clamps screws fastening the bearing ring to one of the plurality of mounting frames thereby compressing the mounting lip of the shell of the drum onto the top plate of the mounting frame, a top head having a drum skin including a peripheral edge portion, the drum skin placed over the top edge of the support wall of the bearing ring across the drum head opening, the peripheral edge portion extending radially outward from the support wall, a top hoop placed over the peripheral edge portion, and a plurality of tension rods, each of the plurality of tension rods threadedly received in the internal bore of one of the plurality of clamp screws and fastening the top hoop to the bearing ring thereby securing the top head on the support wall of the bearing ring.

13. A marching tenor drum assembly having a unitary multiple-drum mounting frame, the marching tenor drum assembly comprising:

a plurality of tenor drums including a set of four tenor drums, and one or more mounting frames including a unitary quad mounting frame and one or more individual drum mounting frames, the quad mounting frame for receiving the four tenor drums, each of the individual drum mounting frames for receiving one of the plurality of tenor drums, each of the individual drum mounting frames for attachment to the quad mounting frame, each of the one or more mounting frames having a top plate including one or more drum openings, the quad mounting frame including a recess formed by a front wall and opposing lateral side walls, the front wall including a plurality of sets of vertically spaced apart anchor slots, each of the one or more individual drum mounting frames includes a rear wall and opposite side walls, the rear wall having a plurality of anchor holes which are horizontally spaced apart to register with a selected one of the plurality of sets of anchor slots, and a plurality of fasteners received in the plurality of anchor holes of each of the one or more individual mounting frames and received in one of the plurality of sets of anchor slots to fasten the mounting frame to the quad mounting frame, each of said plurality of tenor drums including:

a cylindrical shell having an upper edge and a mounting lip extending radially therefrom, the shell received in one of the one or more drum openings of one of the one or more mounting frames with the mounting lip resting on the top plate thereof, a bearing ring having an annular compression rim and an annular support wall, the compression rim covering the mounting lip of the shell, the support wall extending upwardly from the compression rim and bounding a drum head opening, a plurality of clamp screws, each of the plurality of clamp screws having a reverse threaded internal bore, the plurality of clamps screws fastening the bearing ring to one of the plurality of mounting frames thereby corn pressing the mounting lip of the shell of the drum onto the top plate of the mounting frame, a top head having a drum skin including a peripheral edge portion, the drum skin placed over the top edge of the support wall of the bearing ring across the drum head opening, the peripheral edge portion extending radially outward from the support wall, a top hoop placed over the peripheral edge portion, and a plurality of tension rods, each of the plurality of tension rods threadedly received in the internal bore of one of the plurality of clamp screws and fastening the top hoop to the bearing ring thereby securing the top head on the support wall of the bearing ring.

* * * * *